US007460438B2

(12) United States Patent
Hudson

(10) Patent No.: US 7,460,438 B2
(45) Date of Patent: Dec. 2, 2008

(54) DOWNHOLE DATA COMMUNICATION

(75) Inventor: Steven Martin Hudson, Sturminster Newton (GB)

(73) Assignee: Expro North Sea Limited, Berkshire (GB)

( * ) Notice: Subject to any disclaimer, the term of this patent is extended or adjusted under 35 U.S.C. 154(b) by 292 days.

(21) Appl. No.: 10/563,082

(22) PCT Filed: Jul. 2, 2004

(86) PCT No.: PCT/GB2004/002853

§ 371 (c)(1),
(2), (4) Date: Dec. 30, 2005

(87) PCT Pub. No.: WO2005/005778

PCT Pub. Date: Jan. 20, 2005

(65) Prior Publication Data

US 2006/0164256 A1 Jul. 27, 2006

(30) Foreign Application Priority Data

Jul. 4, 2003 (GB) ..... 0315730.2

(51) Int. Cl.
*H04H 9/00* (2006.01)

(52) U.S. Cl. ..... 367/83; 340/854.3; 106/313; 106/369

(58) Field of Classification Search ..... 367/82, 367/83; 340/853.1, 854.3; 166/313, 369
See application file for complete search history.

(56) References Cited

U.S. PATENT DOCUMENTS

| | | | |
|---|---|---|---|
| 3,764,970 | A | 10/1973 | Manning |
| 4,703,461 | A | 10/1987 | Kotlyar |
| 4,771,408 | A | 9/1988 | Kotlyar |
| 4,774,694 | A | 9/1988 | Moll |
| 4,932,005 | A | 6/1990 | Birdwell |
| 5,079,750 | A | 1/1992 | Scherbatskoy |
| 5,113,379 | A | 5/1992 | Scherbatskoy |
| 5,390,153 | A | 2/1995 | Scherbatskoy |
| 5,576,703 | A | 11/1996 | MacLeod et al. |
| 5,740,126 | A | 4/1998 | Chin et al. |
| 5,868,201 | A | 2/1999 | Bussear et al. |
| 5,975,204 | A | 11/1999 | Tubel et al. |
| 6,097,310 | A | 8/2000 | Harrell et al. |
| 6,105,690 | A | 8/2000 | Biglin, Jr. et al. |
| 6,604,581 | B2 | 8/2003 | Moake et al. |
| 6,604,582 | B2 | 8/2003 | Flowers et al. |
| 6,629,564 | B1 | 10/2003 | Ramakrishnan et al. |
| 6,637,119 | B2 | 10/2003 | Russell et al. |

(Continued)

FOREIGN PATENT DOCUMENTS

| | | |
|---|---|---|
| EP | 0 450 207 | 10/1991 |

(Continued)

OTHER PUBLICATIONS

International Application No. PCT/GB2004/002853; Filed Feb. 7, 2004.

*Primary Examiner*—Albert K. Wong
(74) *Attorney, Agent, or Firm*—Alston & Bird LLP

(57) ABSTRACT

A data communication technique for use in producing wells. Signals are transmitted through the product (p) by varying and monitoring flow rate at respective ends of the communication channel. At low data rates robust communication can be provided.

25 Claims, 3 Drawing Sheets

U.S. PATENT DOCUMENTS

| | | | | |
|---|---|---|---|---|
| 6,644,110 | B1 | 11/2003 | Curtis et al. | |
| 6,644,402 | B1 | 11/2003 | Sharma et al. | |
| 6,644,403 | B2 | 11/2003 | Pichery et al. | |
| 6,648,082 | B2 | 11/2003 | Schultz et al. | |
| 6,650,280 | B2 | 11/2003 | Arndt et al. | |
| 6,655,452 | B2 | 12/2003 | Zillinger | |
| 6,659,197 | B2 | 12/2003 | Cooper | |
| 6,668,465 | B2 | 12/2003 | Noureldin et al. | |
| 6,899,178 | B2 * | 5/2005 | Tubel | 166/313 |
| 6,951,252 | B2 * | 10/2005 | Restarick et al. | 166/313 |
| 2002/0105858 | A1 | 8/2002 | Winnacker | |
| 2003/0000707 | A1 | 1/2003 | Flowers et al. | |
| 2003/0145986 | A1 | 8/2003 | Evans et al. | |
| 2003/0147360 | A1 | 8/2003 | Nero et al. | |
| 2003/0150263 | A1 | 8/2003 | Economides et al. | |
| 2003/0151977 | A1 | 8/2003 | Shah et al. | |
| 2003/0155121 | A1 | 8/2003 | Jones et al. | |
| 2003/0155152 | A1 | 8/2003 | Dybdahl | |
| 2003/0162670 | A1 | 8/2003 | Sweatman et al. | |
| 2003/0168258 | A1 | 9/2003 | Koederitz | |
| 2003/0188862 | A1 | 10/2003 | Streich et al. | |
| 2003/0192689 | A1 | 10/2003 | Moake et al. | |
| 2003/0209066 | A1 | 11/2003 | Goodwin | |
| 2003/0218547 | A1 | 11/2003 | Smits et al. | |
| 2003/0226663 | A1 | 12/2003 | Krueger et al. | |

FOREIGN PATENT DOCUMENTS

| | | |
|---|---|---|
| EP | 0 744 527 | 11/1996 |
| EP | 1 335 108 | 8/2003 |
| EP | 1 365 103 | 11/2003 |
| FR | 2 721 347 | 12/1995 |
| GB | 2 160 565 | 12/1985 |
| GB | 2 290 320 | 12/1995 |
| GB | 2 368 861 | 5/2002 |
| GB | 2 384 797 | 8/2003 |
| GB | 2 386 390 | 9/2003 |
| GB | 2 386 625 | 9/2003 |
| GB | 2 388 132 | 11/2003 |
| GB | 2 388 495 | 11/2003 |
| GB | 2 388 856 | 11/2003 |
| GB | 2 389 601 | 12/2003 |
| GB | 2 389 907 | 12/2003 |
| WO | WO 02/25052 | 3/2002 |
| WO | WO 02/27139 | 4/2002 |
| WO | WO 02/29200 | 4/2002 |
| WO | WO 02/29441 | 4/2002 |
| WO | WO 02/36936 | 5/2002 |
| WO | WO 02/059460 | 8/2002 |
| WO | WO 02/059461 | 8/2002 |
| WO | WO 02/072993 | 9/2002 |
| WO | WO 03/067029 | 8/2003 |
| WO | WO 03/067828 | 8/2003 |
| WO | WO 03/069120 | 8/2003 |
| WO | WO 03/071090 | 8/2003 |
| WO | WO 03/076764 | 9/2003 |
| WO | WO 03/089758 | 10/2003 |
| WO | WO 03/089760 | 10/2003 |
| WO | WO 03/091540 | 11/2003 |
| WO | WO 03/093872 | 11/2003 |
| WO | WO 03/095794 | 11/2003 |
| WO | WO 03/096073 | 11/2003 |
| WO | WO 03/096075 | 11/2003 |
| WO | WO 03/097992 | 11/2003 |
| WO | WO 03/097997 | 11/2003 |
| WO | WO 03/097999 | 11/2003 |
| WO | WO 03/100217 | 12/2003 |
| WO | WO 03/100218 | 12/2003 |
| WO | WO 03/101047 | 12/2003 |

* cited by examiner

DOWNHOLE DATA COMMUNICATION

BACKGROUND OF THE INVENTION

This invention relates to downhole data communication in wells where there is a flow of product from the formation towards the surface.

A well in which there is a flow of product from the formation towards the surface is typically called a "producing well" and correspondingly the present application is related to data communication in producing wells.

There are a number of well known data communication techniques for use in wells. Whilst drilling, and during other operations in which mud is circulated through/present in the well, a communication technique known as mud pulsing is sometimes used. This technique has drawbacks and cannot be used in a producing well because of the absence of mud.

On the other hand, there are electrical based techniques either making use of cables passed down into the well or wireless systems and these can be used both during production and at other times. However, these electrical based systems have their own drawbacks. In the case of cable based systems there is the drawback that the cables must be provided down to the transmitting location and there are considerable implementation difficulties, restrictions on range, and power requirement problems for the wireless systems.

Therefore, it is desirable to have alternative data communication techniques for use in producing wells. It is an aim of the present application to provide such alternative techniques.

SUMMARY OF THE INVENTION

According to one aspect of the invention there is provided a method of downhole data communication in a well in which there is a flow of product from the formation towards the surface, the data communication taking place between two locations in the flow path, at least one of which is downhole in the well, and the method comprising the steps of:

controlling a flow rate of the product at a first of the two locations in dependence on data to be transmitted;

detecting, at the second of the two locations, the effect of said controlling of the flow rate of the product at the first location; and using the results of the detecting step to extract the data transmitted.

According to another aspect of the invention there is provided downhole data communication apparatus for use in a well in which there is a flow of product from the formation towards the surface and where the data communication takes place between two locations in the flow path, at least one of which is downhole in the well, the apparatus comprising:

control means for controlling a flow rate of the product at a first of the two locations in dependence on data to be transmitted;

means for detecting, at the second of the two locations, the effect of controlling of the flow rate of the product at the first location; and means arranged to extract transmitted data using the output of the detecting means.

According to another aspect of the invention there is provided a method of downhole data communication in a well in which there is a flow of product from the formation towards the surface comprising the step of transmitting data by modulating the flow rate of the product to encode the data.

According to another aspect of the invention there is provided downhole data communication apparatus for use in a well in which there is a flow of product from the formation towards the surface and where the data communication takes place between two locations in the flow path, at least one of which is downhole in the well, the apparatus comprising:

a flow rate controller for controlling a flow rate of the product at a first of the two locations in dependence on data to be transmitted;

a detector disposed at the second of the two locations, for detecting the effect of controlling of the flow rate of the product at the first location; and an analyser to extract transmitted data using the output of the detecting means.

The means for detecting/the detector introduced above may comprise pressure sensing means. The pressure sensing means may be arranged to detect absolute pressure or may be arranged to detect a pressure differential.

Typically the effect, at the second location, of controlling of the flow rate of the product at the first location will be a variation in flow rate at the second location. Such a variation in flow rate may be detected. A flow rate meter may be used at the second location to detect the flow rate seen there as the flow rate is varied at the first location. Thus the means for detecting/the detector introduced above may comprise a flow rate meter.

Operation of the system to vary flow rate at the first location and even better, at the second location as well, is helpful in making the system practical with highly compressible (and possibly multiphase) fluids, ie the highly compressible product found in some wells. In contrast pulsing techniques such as mud pulsing require incompressible or nearly incompressible fluids or at the very least homogenous fluids. An advantage of the current methods is that in most typical installations there is a substantially leak proof fluid path between all points of interest in an operating well regardless of the specific structure so there is always or nearly always a useable signal path.

The flow rate meter may comprise a chamber, an elongate orifice having one end in fluid communication with the chamber and another end exposable to the ingress of fluid from a fluid flow, the flow rate of which flow is to be measured, and pressure sensing means for sensing the pressure in the chamber.

According to another aspect of the invention there is provided a flow rate meter comprising a chamber, an elongate orifice having one end in fluid communication with the chamber and another end exposable to the ingress of fluid from a fluid flow, the flow rate of which flow is to be measured, and pressure sensing means for sensing the pressure in the chamber.

The pressure sensing means may be arranged for sensing the pressure across the orifice.

The pressure sensing means may comprise a first pressure sensing element for sensing the pressure in the chamber and a second pressure sensing element for sensing the pressure in the fluid flow in the region of said other end of the orifice.

Preferably, however, the pressure sensing means is a differential pressure sensing means arranged to sense the differential pressure between fluid in the chamber and fluid in the fluid flow in the region of said other end of the orifice.

The flow rate meter may comprise a control unit for calculating the flow rate in the fluid flow using the output of the pressure sensing means.

In other embodiments a conventional flow rate meter may be used.

The control of the flow rate at the first location may be carried out in such a way as to produce measurable changes in flow rate at the second location. In practice this will often mean keeping the nominal flow rate at the first location at a given level for at least a minimum period chosen to allow this change in flow rate to propagate to the second location.

A valve may be used in controlling the flow rate at the first location. The means for controlling the flow rate/the flow rate controller may comprise a valve. It is currently preferred that the valve is a sleeve valve, but other forms of valves such as ball valves may be used.

These methods and apparatus may be used to communicate in either or both directions in a well. Thus the first location might be a downhole location but equally might not be downhole and could be, for example, at the well head or at a surface location remote from the well head. Similarly, depending on the position of the first location, the second location may be downhole, at the well head or at a remote surface location etc. The remote location may be at a central processing facility. In some situations, the remote location may be secure against tampering in contrast to the well head.

In order to achieve two way communication, the method may comprise the further steps of:

controlling a flow rate of the product at the second location in dependence on data to be transmitted;

detecting, at the first location, the effect of said controlling of the flow rate of the product at the second location; and using the results of the detecting step at the first location to extract the data transmitted.

Similarly the apparatus may further comprise:

second location control means for controlling a flow rate of the product at the second location in dependence on data to be transmitted from the second location;

first location detecting means for detecting, at the first location, the effect of controlling of the flow rate of the product at the second location; and means arranged to extract data transmitted from the second location using the output of the first location detecting means.

In one set of embodiments the apparatus may comprise a first valve disposed at the first location and a second valve disposed at the second location, each for use in controlling the flow of product at the respective location.

A variety of different modulation schemes may be used to encode data onto the flow of product. Frequency modulation techniques may be used. It is preferred to use digital techniques. Pulse position modulation may be used. Bipolar Phase Shift Keying (BPSK) may be used. The modulation scheme may be chosen such that the average flow rate is that required for production.

In some cases, such as when using pulse position modulation, "tones" may be applied to the flow rate in preference to plain signals such as pulses, for example square pulses. Here the expression tone is used to mean a smoothly varying variation in flow rate, possibly a sinusoidal variation, which is analogous to an audio tone that could be transmitted in conventional electrical communication system. The use of tones can aid in the detection of the transmitted signals, for example by making available the use of correlation techniques.

The frequency of such tones and/or other frequencies used in modulation techniques may be selected to minimize the effect of noise in the system. Typically one source of noise will consist of variations in the flow rate and composition of product leaving the formation and entering the production tubing of the well. One well known phenomenon is that of "slugs" of higher or lower density material exiting the formation and travelling up the tubing as one mass. In practice in a gas well, a slug will be a pocket of oil and in an oil well, a slug will be a pocket of gas. The use of frequency based modulation schemes can help to minimise the adverse effects of slugs on data transmission. The length of tones used and modulation depth may be chosen to further reduce the effect of slugs.

The system may be arranged to allow communication between a plurality of transmitting locations and a plurality of receiving stations. Different frequencies of flow rate modulation may be used to allow simultaneous transmission from a number of transmitting locations and/or to allow identification of the transmitting location. Different frequency tones may be used.

In one particular implementation the communication system may be used in a well having a series of bores connecting into a main bore—a so called multi-lateral well. The apparatus and method may be such as to allow communication between a plurality of branches in a multi-lateral well and the well head.

The control means may be arranged to actively smooth undesired fluctuations in the flow rate. Similarly the transmission method can comprise the step of actively smoothing undesired fluctuations in the flow rate. In such a way, the effect of noise in the transmission path can be reduced.

For implementing active smoothing, the control means may, comprise a valve for controllably restricting the product flow rate, comprise a sensor for sensing pressure in the region of the valve, and be arranged to vary the flow restriction provided by the valve in dependence on the pressure sensed. In one set of embodiments the pressure drop across the valve is sensed. In another set of embodiments the absolute pressure downstream of the valve is sensed. The choice of which pressure measurement to use may vary depending on the fluid characteristics and the tubing dimensions. In some instances the flow restriction may be varied in such a way as to attempt to keep the pressure drop sensed/pressure sensed at a selected level or within a selected range. A plurality of selected levels may be used in a signalling technique and the flow restriction varied in an aim to keep the pressure drop/pressure at a chosen one of the plurality of selected levels at any one time in accordance with the signals to be sent.

A pump may be provided at the first location to aid in control of the flow rate at the first location. A pump may also be provided at the second location. The pump at the second location can be used in, but not exclusively in, systems where there is bi?directional signalling. Thus the control means may comprise a pump and the second location control means may comprise a pump.

According to a further aspect of the present invention there is provided a transmitter module for use in a producing well downhole communication method, the module being arranged for location at least partially in tubing carrying product and comprising a controllable valve for controlling the flow rate of product through the tubing and a control unit for controlling the valve and hence the flow rate in dependence on data to be transmitted.

According to yet a further aspect of the present invention there is provided a receiver module for use in a producing well downhole communication method, the module being arranged for location at least partially in tubing carrying product and comprising, a flow rate meter for measuring the flow rate of product through the tubing, and a control unit for analysing the output of the flow rate meter to extract data carried by variations of the flow rate.

The module may be a transceiver module providing both transmit and receive functions.

BRIEF DESCRIPTION OF THE DRAWINGS

Embodiments of the present invention will now be described by way of example only with reference to the accompanying drawings in which.

DETAILED DESCRIPTION OF THE DRAWINGS

Figure 1:
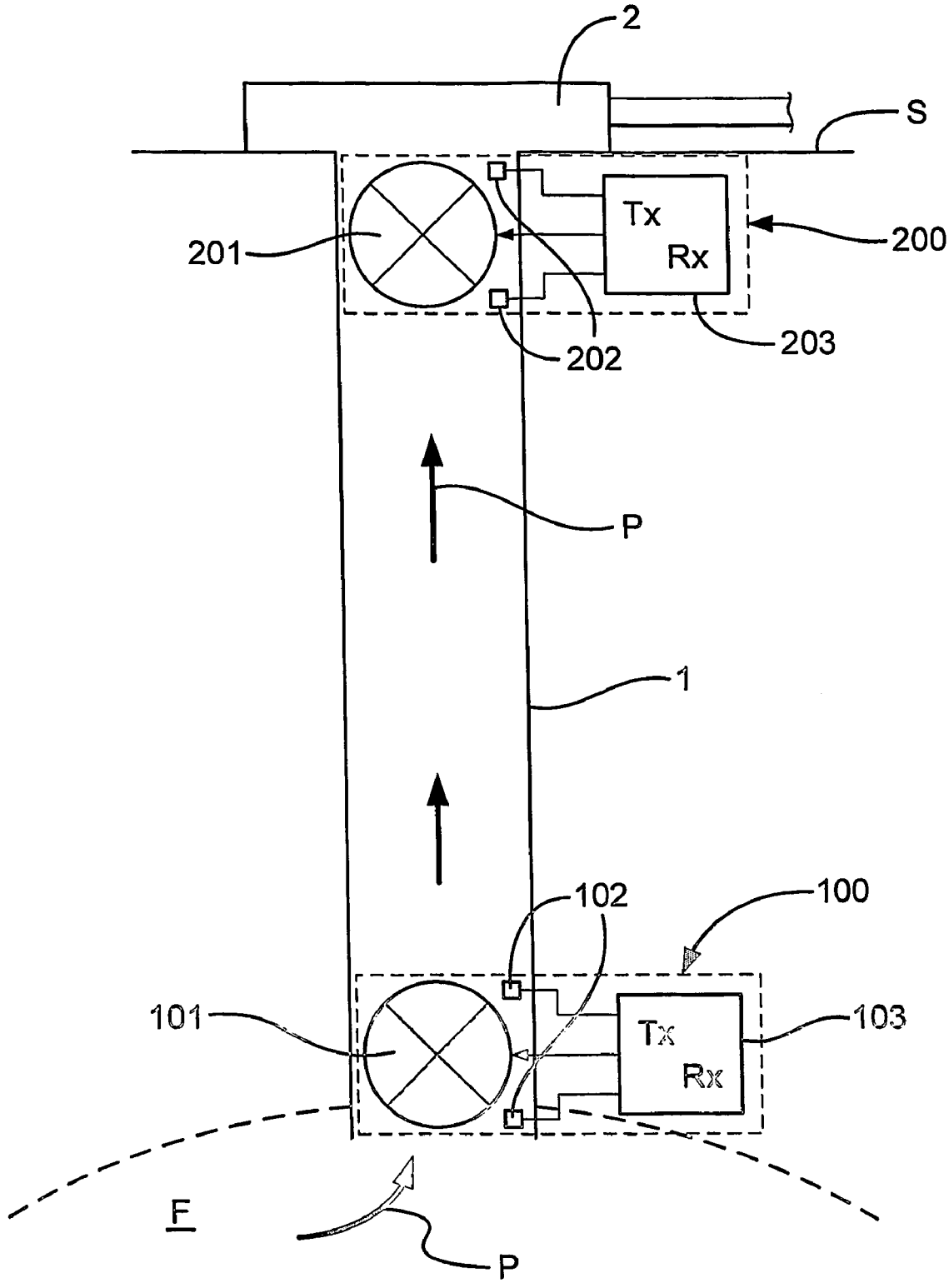
FIG. 1 schematically shows a well including a data communication system embodying the present invention.

FIG. 1 schematically shows a well incorporating a data communication system embodying the present invention. The well comprises production tubing 1 for channelling the flow of product P, indicated by arrows in FIG. 1, from the formation F to the well head 2 at the surface S.

The present data communication technique is for use in producing wells, and at one level, the communication technique may be stated to comprise the principle of modulating the flow rate of product from the formation to the surface in order to transmit the data within the well.

In the present embodiment, apparatus is provided to facilitate the communication of data in both directions within the well. Thus, the data communication apparatus for use in the data communication system comprises a downhole module 100 and a well head module 200.

The structure and arrangement of the downhole and well head modules 100, 200 are substantially the same in this embodiment and the corresponding elements are given the same reference numerals except that in the case of the downhole module 100 the reference numerals start with 10 and in the well head module 200 the reference numerals start 20.

Whilst the modules 100, 200 are disposed at the well head 2 and formation F in this embodiment, it should be noted that, in other embodiments, the modules can be placed elsewhere in the flow path. As an example one module might be located in piping remote from the well head 2 which leads product away from the well.

In this embodiment each module comprises a controllable valve 101, 201, disposed in the product flow path within the production tubing 1 of the well. Either side of each controllable valve 101, 102 is a respective pressure sensor 102, 202 so that each module 100, 200 has a pair of pressure sensors 102, 202 for sensing the pressure across the respective valve 101, 201.

Each module 100, 200 further comprises a respective control unit 103, 203 which is used to control the controllable valve 101, 201 and receive inputs from the pressure sensors 102, 202. For the sake of clarity in the drawings, the control units 103, 203 are shown outside the production tubing in FIG. 1. In practice however, in this embodiment the control units 103, 203 are provided together with all of the other components of the respective modules 100, 200 within a self-contained tool which is provided within the production tubing 1.

This tool (known as a downhole assembly in the case of the downhole module 100) can be made having a length in the order of 4 to 5 m and an outside diameter of less than 50 mm (2 inches). As well as the components shown in FIG. 1, each tool also includes a setting device for holding the tool 100, 200 in position in the tubing 1 and a battery pack to provide power to operate the valve 101, 201, the sensors 102, 202 and the control unit 103, 203.

In operation, data may be sent from the downhole module 100 to the well head module 200 and similarly data may be sent from the well head module 200 to the downhole module 100. In general terms however, the system should be treated as a half duplex system in that it is unlikely to be often practical to communicate in both directions simultaneously.

During data communication from the downhole module 100 to the well head module 200, the control unit 103 in the downhole module 100 is used to control the downhole valve 101 to vary the flow rate of product P up the production tubing 1 towards the well head module 200. In particular, the valve 101 is used to vary the flow of product P in dependence on the data to be transmitted from the downhole module 100. In other words, the downhole valve 101 is used to modulate the flow of product P up the production tubing.

As the flow of product P reaches the well head module 200, the effect of this downhole modulation of the product flow is detected by the pair of pressure sensors 202 whose outputs are received by the well head control unit 203. The well head control unit 203 is arranged to extract the data transmitted from the outputs of the well head sensors 202.

Typically the valve 101 in the downhole module 100 is used to vary the flow rate of product P downhole in such a way that the variations in flow rate (rather than just changes in pressure) have time to propagate to the well head. This means that the sensors 202 can pick up differences in flow rate of the product and it is from these differences in flow rate seen at the well head that the data can be extracted.

Data may be transmitted from the well head module 200 to the downhole module 100 in a similar fashion. In this case, product is still flowing up the production tubing from the formation F to the surface S but again it is possible to control its flow rate by use of the controllable valve 201 at the well head module 200. Again, the flow rate at the well head 2 is modulated in accordance with the data to be transmitted and the modulation scheme is chosen such that there is time for the differences in flow rate to propagate down to the downhole module 100 and particularly such that it may be sensed by the downhole pressure sensors 102. The outputs of the downhole pressure sensors 102 may then be interpreted by the downhole control unit 103 to extract the data transmitted from the well head module 200.

Figure 2:
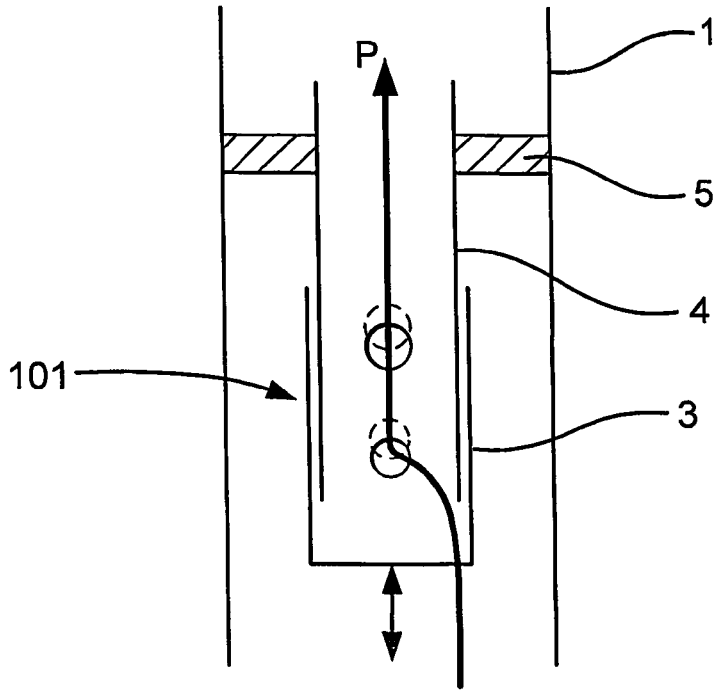
FIG. 2 schematically shows a valve used in the data communication system of FIG. 1, FIGS. 3*a* and 3*b* schematically shows signals which may be sent in the transmission of data in the system shown in FIG. 1.

FIG. 2 shows the valve 101 of the downhole module 100 in more detail. The well head valve 201 is of similar construction. In this case the downhole valve 101 is a sleeve valve which comprises two sleeve portions 3 and 4 which are arranged to slide within one another. A plurality of apertures are provided in the side walls of both of the sleeves 3, 4 and by relative movement between the two sleeves 3, 4 the apertures may be moved from a position where they are lined up entirely with one another such that there is a free fluid flow path through the walls of both sleeves to a position where the apertures do not line up with each other at all, such that there is no fluid passage through the walls of the sleeves.

Of course, between these two extreme positions, there are positions where the apertures are partially aligned such that there is a fluid flow path through the walls of the sleeves 3, 4 but this has a smaller cross sectional area than when the apertures are completely aligned.

The inner sleeve 4 of the sleeve valve is mounted in a pressure proof packer 5 within the production tubing 1 so that the only path for product within the production tubing 1 in the region of the sleeve valve is through the apertures in the walls of the sleeves 3, 4 and through the interior of the inner sleeve 4. Thus, by varying the relative positions of the two sleeves 3, 4 the valve 101 can be used to provide a variable restriction in the flow path.

Any one of various forms of actuator may be provided for driving the sleeves 3, 4 relative to one another. These include a motor and gear drive, a solenoid or a smart metal alloy based actuator. The sleeves may be moved relative to one another in an axial direction as indicated in the double headed arrow in FIG. 2 or if preferred, rotationally relative to one another.

The sleeve valve may be arranged so that the total cross sectional area of fluid flow path provided by the apertures when fully aligned is substantially the same as the internal cross sectional area of the production tubing.

Whilst sleeve valves are used in the present embodiment, other forms of valve might be used in apparatus of the present type, for example, ball valves.

There are a wide variety of different modulation schemes which may be used in implementing the present system, although there are various limitations which must be taken into account. First, and most obviously, the function of the well is to extract product from the formation F and therefore, any modulation scheme used must not interfere with the flow of product to such an extent that the primary function of the well is significantly affected. However, in many circumstances, satisfactory modulation may be achieved without adversely affecting the performance of the well.

As a starting point, the modulation scheme may be chosen such that over a predetermined period such as a day, the average flow rate within the system is that required for general production reasons, and the modulation scheme may function by causing variations in flow rate either side of this average flow rate.

In general terms, the data rates achievable with the system of the type shown in FIG. 1 will be relatively low and might be in the order of 100 bits per day. However, such a data rate is sufficient if only a few pressure and temperature measurements are to be taken and transmitted to the surface each day or at other selected times.

Provided that the modulation scheme is chosen carefully and, in particular, provided that changes to flow rate induced by operating the valves 101, 102 are maintained for long enough for the changes in flow rate to propagate along the production tubing, then it is anticipated that in at least some cases altering the flow rate in an oil well by +/−20% around an average flow rate will produce detectable variations in flow rates such that data transmission may be achieved. Such variations in flow rate may result in a change of something in the order of 6-10 psi in well output pressure.

In the case of a gas producing well then it is anticipated to be necessary to vary the flow rate more significantly perhaps by +/−50% around an average flow rate. The differences in pressure seen by virtue of such fluctuations are likely to be several orders of magnitude lower than the figure given above for oil wells.

It is preferred that digital signalling techniques are used, and frequency modulation techniques can be particularly effective in reducing the effects of noise which will be seen due to variations in the composition of product leaving the formation. Two modulation schemes which are seen to be particularly viable at present are bipolar phase shift keying (BPSK) and pulse position modulation.

Figure 3A:
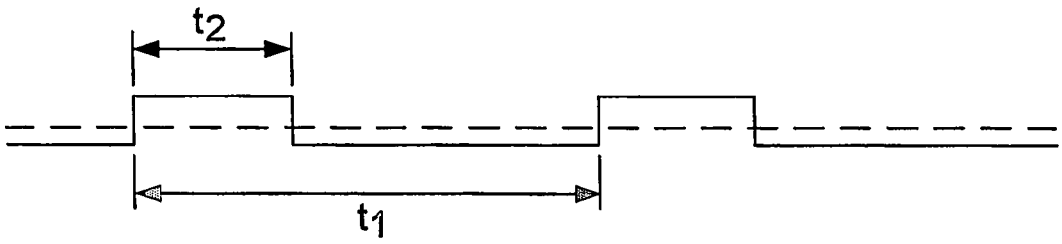
Figure 3B:
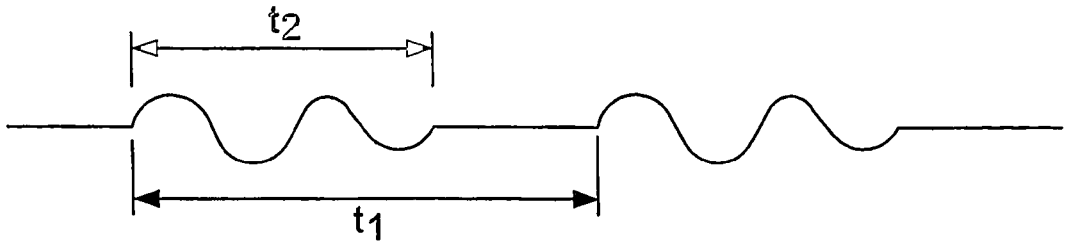

FIGS. 3A and 3B show possible signal forms which may be used during pulse position modulation. The dotted line in FIG. 3A represents the average flow rate which is modulated to encode data. In pulse position modulation the data is encoded by virtue of the time elapsed between subsequent pulses, i.e. time t1 shown in FIGS. 3A and 3B.

This form of modulation is particularly suited to situations like the present where a relatively small amount of data is to be transmitted and a relatively long time is available. This means that t1 may be varied over a large time range to encode the data whilst the actual time spent transmitting (represented by t2 in FIGS. 3A and 3B) can be relatively small. In this way, time is effectively used as a resource and the amount of battery power used for transmission is minimised. In the present case, the length of transmission time t2 will be chosen such that the variation in flow rate caused has time to propagate along the production tubing to the respective receiving station.

Of course, in the present data communication technique, once the flow rate is set to a certain level, i.e. once the valve 102, 202 is set to a certain setting, then there is no continuing usage of electrical power in contrast to an electrical based system.

Therefore, if plain, for example, square pulses are transmitted as shown in FIG. 3A, electrical power is used at the transmitting module only as the valve is operated at the start and end of each pulse. In such cases, limiting the transmission time t2 is not of great importance for power saving, but the facility to send data whilst minimising the number of pulses sent is of importance and pulse position modulation is still useful for this reason.

On the other hand, in at least in some instances, it is preferred to send "tones" ie sinusoidal (or other smoothly varying variations in flow rate) signals since these can help in the transmission and extraction of data. In particular, correlation techniques can be used to both help in the detection of the tones at the reception end and in giving an accurate timing between subsequent signals.

FIG. 3B shows a possible signal which may be sent in a pulse position modulation scheme where tones rather than plain pulses are put onto the product flow.

In such a case, the valve must be operated continuously during the transmission time t2. Here, therefore, limiting t2 helps to minimise the power used in transmission. However, there is, of course, a trade off in terms of detectability of the signal when shortening the signals. Because of this, the length of the transmission pulses t2 needs to be chosen carefully and will differ for different installations depending, for example, on the length of producing tubing over which the signals are to be transmitted.

It is expected that the present data communication technique will be effective for sending signals over large distances for example 6,000 m (20,000 feet). In general terms there is a relationship between the data rate achievable and the distance over which the signals need to be sent. Therefore, in the case of a 125 mm (5 inch) production tubing, if signals are to be sent over 3,000 m (10,000 feet) of production tubing then a data rate of 100 bits per day might be achievable, whereas, if the signals are to be sent over 4,500 m (15,000 feet) the data rate might fall to 50 bits per day, and if the signals are to be sent 6,000 m (20,000 feet) the data rate might fall to 25 bits per day.

In practice the modulation scheme used may be varied for different installations in an effort to give detectable signals and the data rate will be determined as a result of this process. In pulse position modulation the length of the pulses and the quantisation of the standard time period between transmissions may be varied in an effort to obtain detectable signals.

The general principles of telecommunications apply to communication using the present techniques. Therefore in determining whether signals can be successfully transmitted the link budget equation applies. Furthermore many techniques used in more conventional telecommunications can be used with the present system. The superposition of different signals having different frequencies on to the flow as a carrier can be carried out and filtering used to extract the signals. Signals can be relayed along a data channel. Broadcast signals can be used—for example an activating signal might be broadcast from a well head to activate one or more of a plurality of downhole modules, for example provided in a multilateral well. There can be communication between a plurality of nodes arranged along the flow path, eg there may be a plurality of modules within the tubing; one at each location where communication is necessary.

As described above the pressure sensors 102 and 202 are used by the respective module 100, 200 during reception of signals. However, they may also be used to perform another function when the respective module is transmitting. The pressure sensors 102, 202 are provided on either side of the respective valve 101, 201 and therefore can be used to measure the pressure drop across the valve during transmission. The measurement of this pressure drop may be used in a scheme to smooth the product flow. This smoothing is useful to counteract the effects of noise in the product flow for example, due to variations in the composition of product leaving the formation, for example, the issuance of slugs by the formation.

When the downhole module 100 is transmitting, the downhole control unit 103 may be used to monitor the pressure drop seen by the sensors 102 and to actively vary the restriction provided by the valve 101 in an effort to keep the pressure drop across the valve 101 at the desired level. That is to say between the imposition of deliberate variations in flow rate onto the product flow to transmit signals, the valve 101 may be used to keep the flow rate in the region of the downhole module 100 as constant as is possible. Moreover, when signals are being sent, the valve may be adjusted in such a way as to keep the flow rate at the appropriate level for signalling.

To put this in terms of a concrete example, there may be a signalling system where the valve 101 is nominally 75% open in the normal state but closes to 50% open during a negative going part of a signal and opens to 100% during a positive going part of a signal.

Thus, without noise compensation, the valve's rest position would be 75% open and when a signal were to be sent the valve would be moved to 50% or 100% open as appropriate.

When active smoothing is used, the pressure drop across the valve 101 is sensed with the valve at the 75% level and the valve adjusted around 75% open in an effort to maintain this pressure drop whilst not signalling. Similarly, during signalling the valve is adjusted around the 50% or 100% level as appropriate to maintain the appropriate pressure drop and hence flow rate.

In effect, in such a system there is a feedback loop where the valve 101 may be adjusted to keep the flow rate as smooth as possible in response to the pressure drop detected by the sensors.

This principle also applies to the well head module 200 where the respective valve 201 may be used to keep the flow rate at the well head as constant as possible.

Although not shown in the drawings, in a further development of this idea, a pump may be provided at the downhole module 100 and/or the well head module 200 for use in smoothing the flow rate. In this case there could be an active feedback loop in which the pump is operated in a way to maintain flow rate. The pump might be used along with valve control to provide the smoothing effect.

In the embodiment shown and described above the pressure sensors 102 and 202 are used for measuring a differential pressure in the production tubing in order to determine flow rate and extract data from the system. In alternatives different techniques may be used for extracting the data. In particular, rather than using a pair of separate pressure sensors a differential pressure sensor may be used. In such a case the differential pressure sensor is arranged to be exposed to the pressure on each side of the respective valve so that the differential pressure across the valve can be measured.

In another implementation measurement of absolute pressure in the product flow may be taken and variations in this used to extract the data.

Figure 4:
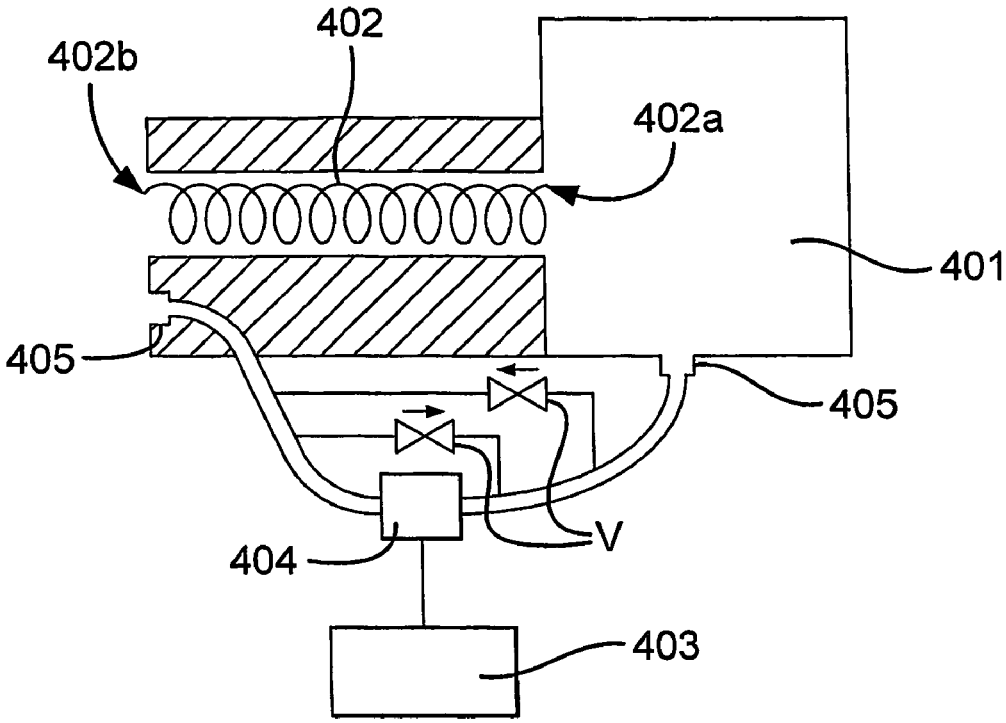
FIG. 4 schematically shows a flow rate meter which may be used in the data communication system of FIG. 1.
Figure 5:
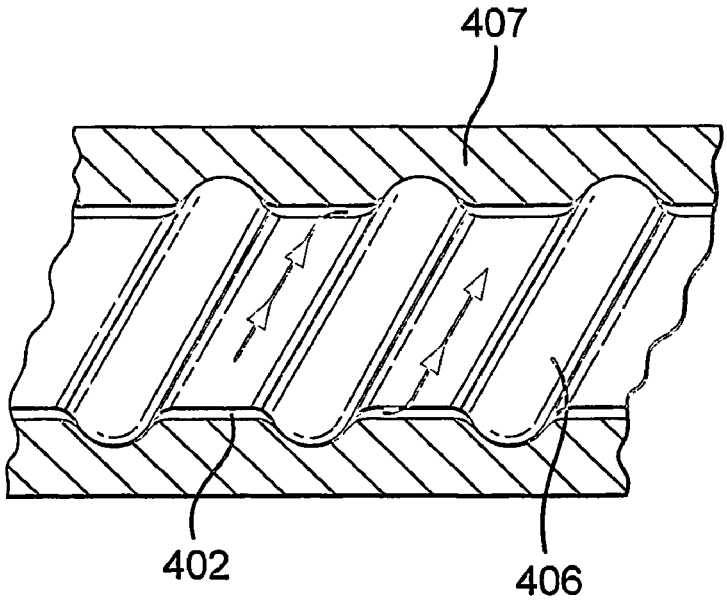
FIG. 5 shows part of the elongate helical orifice provided in the flow rate meter of FIG. 4.

In an alternative, a new form of flow rate meter as shown in FIGS. 4 and 5 and described below may be used to measure flow rate in the above systems. This flow rate meter however, can also be used for measuring flow rate in other circumstances.

In the flow rate meter shown in FIGS. 4 and 5, there is chamber 401 which, in normal operation, is fluid tight except for the existence of an elongate orifice 402 one end of which 402*a* opens into the chamber 401 and another end of which 402*b* is exposable to a fluid flow. The chamber also includes a release valve (not shown) to allow gas, typically air, to escape from the chamber 401 when the orifice 402 is first exposed to fluid flow and the chamber fills with the fluid. After this initial set up, however, the release valve typically remains closed.

The flow rate meter further comprises a control unit 403 and a differential pressure sensor 404, an output of which is connected to the control unit 403. Respective ports 405 are provided in the flow rate meter to allow the differential pressure sensor 404 to sense the differential pressure between the interior of the chamber 401 and the fluid flow in the region of the exposable end 402*b* of the orifice. One of the ports 405 runs between the differential pressure sensor 404 and the interior of the chamber 401 and the other port 405 runs between the differential pressure sensor 404 and a location in the region of the exposable end 402*b* of the orifice 402.

This set up allows the pressure drop across the elongate orifice 402 to be measured. The control unit 403 makes use of the pressure measurements from the pressure sensor 404 to determine the flow rate at any instant.

A pair of opposing pressure release valves V are connected between the ports 405 to protect the sensor 404. Each valve V is for allowing pressure release in a respective direction between the ports 405.

As mentioned above, on first exposure to fluid flow, the chamber 401 fills with fluid as this progresses along the orifice 402. At the same time the appropriate release valve opens because of the large pressure difference, and this creates a further fluid path into the chamber 401.

After this initial stage, changes in flow rate in the fluid flow tend to drive further fluid into the orifice or cause the fluid to recede—this changes the pressure in the chamber 401 in a way that depends on flow rate and allows flow rate to be determined. The release valves V should remain closed in normal operation.

To efficiently produce a compact device, the elongate orifice 402 is produced by machining two interthreadable components such that the threads do not perfectly match and there is a helical orifice running between the mating threads. FIG. 5 shows part of the mating threaded components of the flow rate meter of FIG. 4. From FIG. 5 it can be seen that there is a threaded bar 406 which is threaded into a threaded sleeve

407 whilst leaving a helical orifice 402 between the troughs of the threads on the bar 406 and the peaks of the threads on the sleeve 407.

The flow rate meter shown in FIGS. 4 and 5 can be considered akin to a resistor and capacitor connected in series between the fluid flow as a source of current and ground. In this analogy, the orifice 402 acts as the resistor and the chamber 401 acts as the capacitor in that the chamber is charged up with fluid as it overcomes the resistance of the orifice. Further, the pressure in the chamber 401 rises and falls in the same way as the voltage across the capacitor would rise and fall over time.

Similarly to the electrical analogy therefore, the orifice 402 and chamber 401 have a time constant which is related to the volume of the chamber 401 and the length and diameter of the orifice 402.

The sensitivity and function of the device may be tuned by changing the internal volume of the chamber 401 and the length and/or diameter of the orifice 402

It will be appreciated that the use of the data communication technique described above does not preclude the use of other, probably, electrical based, communication systems within the same well. Thus an electrical based system of communication, preferably a wireless form of communication such as that previously developed by the applicant and described in previous patent applications, may be also provided in the well. The electrical based communication system might be used as a back up in case there are instances where the present system does not function satisfactorily or for use during periods where there is no flow of product from the formation F to the surface S.

The present flow modulation schemes may also be used in conjunction with electrical based systems to form a hybrid system, ie a system where the signal is carried by a modulated flow rate for part of the signal path and is carried by an electrical carrier by for the remainder of the path. One example of a useful monitoring hybrid system is for monitoring pressure and temperature below a plug in a disused section of a well. As there is no product flow below the plug an electrical technique can be used to transmit over that section and as far as a flow modulation module on the operational side of the plug.

One instance where the present flow modulation techniques have a particular advantage over electrical techniques is in an offshore case where a number of wells electrically connect to the platform structure either at the seabed or higher up. In such installations, when using most electrical systems, a downhole pick-up cable is essential. However, this may be impractical or too expensive to install. Because the signal path, ie the product flow path, in the present methods is designed not to leak there is a continuous path through any such structure and no similar need for a cable pick up.

As mentioned above one of the locations in the communication system may be remote from the well head so that data sent from downhole in a well may be picked up by monitoring the flow at a considerable distance from the well. This distance could for example be several km. Use of this remote detection capability may be made for a 'step out' well where pick up is made at a main platform or in a land based installation, so that pick up can be made at a central processing facility. This can help to limit equipment at the well or at an exposed location to help prevent damage and/or tampering.

Of course in general the flow of product terminates at a location with significant infrastructure and in many circumstances the data may be extracted from the flow at that location or at a convenient location in between there and the well.

Modelling carried out has suggested that in a typical well with no substantial gas present in the product, an upper limit for a carrier frequency which may be usefully used in implementing these techniques is in the order of say 0.1 Hz. If gas is present this upper limit will drop by say 1 or 2 orders of magnitude. In one implementation proposed by the applicants a phase shift based modulation scheme is used with a carrier frequency of $1/3600$ Hz. These figures are given purely by way of example and serve to indicate the order of frequency which may be used. As will be clear to those skilled in the art, in practice usable frequencies for a given installation may be easily determined empirically.

The invention claimed is:

1. A method of downhole data communication in a producing well in which there is a flow path for a flow of produced product from the formation towards the surface, the data communication taking place between two locations in the flow path, at least one of which is downhole in the well, and the method comprising the steps of:

collecting the produced product from the formation and causing or allowing the produced product to flow toward the surface;

controlling a flow rate of the produced product at a first of the two locations in dependence on data to be transmitted;

detecting, at the second of the two locations, the effect of said controlling of the flow rate of the produced product at the first location; and using the results of the detecting step to extract the data transmitted, wherein the step of controlling the flow rate of the produced product at the first of the two locations comprises modulating the flow rate so as to encode said data onto a carrier frequency that is below 0.1 Hz.

2. A method according to claim 1 comprising the step of keeping the nominal flow rate at the first location at a state for at least a minimum period chosen to allow this change in state to propagate to the second location.

3. A method according to claim 1 comprising the step of altering the flow rate of the product at the first location by at least +/−20% about an average flow rate to encode data to be transmitted.

4. A method according to claim 1 comprising the further steps of:

controlling a flow rate of the produced product at the second location in dependence on data to be transmitted;

detecting, at the first location, the effect of said controlling of the flow rate of the produced product at the second location; and using the results of the detecting step at the first location to extract the data transmitted.

5. A method according to claim 1 in which the flow is modulated using a scheme arranged such that the average flow rate is that required for production.

6. A method according to claim 1 in which variations in flow rate created at the first location are applied in the form of tones.

7. A method according to claim 1 comprising the step of communicating between a plurality of branches in a multilateral well and the well head.

8. A method according to claim 1 comprising the step of actively smoothing undesired fluctuations in the flow rate.

9. A method according to claim 8 comprising the steps of using a valve to controllably restrict the flow rate at the first location, sensing a pressure in the region of the valve and varying the flow restriction provided by the valve in dependence on the pressure sensed.

10. A method according to claim 9 comprising the step of using a plurality of predetermined levels of flow rate in a signalling technique and varying the flow restriction provided by the valve in an aim to keep the flow rate at a selected one of the plurality of predetermined levels at any one time in accordance with the signals to be sent.

11. A method according to claim 1, in which the detecting step comprises the step of measuring, at the second of the two locations, the flow rate of the produced product to detect variations in flow rate of the produced product at the second location caused by said controlling of the flow rate of the produced product at the first location.

12. Downhole data communication apparatus for use in a producing well in which there is a flow path for a flow of produced product from the formation towards the surface and where the data communication takes place between two locations in the flow path, at least one of which is downhole in the well, the apparatus comprising:

means for collecting the produced product from the formation and causing or allowing the produced product to flow toward the surface;

a flow rate controller for controlling a flow rate of the produced product at a first of the two locations in dependence on data to be transmitted;

a detector disposed at the second of the two locations, for detecting the effect of controlling of the flow rate of the produced product at the first location; and an analyzer to extract transmitted data using the output of the detector, wherein the flow rate controller is arranged to modulate the flow rate so as to encode said data onto a carrier frequency that is below 0.1 Hz.

13. Apparatus according to claim 12, in which the detector comprises a flow rate detector.

14. Apparatus according to claim 13, in which the flow rate detector comprises a flow rate meter which comprises a chamber, an elongate orifice having one end in fluid communication with the chamber and another end exposable to the ingress of fluid from a fluid flow, the flow rate of which flow is to be measured, and a pressure sensor for sensing the pressure in the chamber.

15. Apparatus according to claim 14 in which the pressure sensor is arranged for sensing the pressure across the orifice.

16. Apparatus according to claim 14 in which the pressure sensor is a differential pressure sensor arranged to sense the differential pressure between fluid in the chamber and fluid in the fluid flow in the region of said other end of the orifice.

17. Apparatus according to claim 12, further comprising:

a second location flow rate controller for controlling a flow rate of the produced product at the second location in dependence on data to be transmitted from the second location;

a first location detector for detecting, at the first location, the effect of controlling of the flow rate of the produced product at the second location; and an analyzer arranged to extract data transmitted from the second location using the output of the first location detector.

18. Apparatus according to claim 12 which is arranged to modulate flow rate using a scheme arranged such that the average flow rate is that required for production.

19. Apparatus according to claim 12 in which the flow rate controller is arranged for applying variations in flow rate in the form of tones.

20. Apparatus according to claim 12 arranged such as to allow communication between a plurality of branches in a multi-lateral well and the well head.

21. Apparatus according to claim 12 in which the flow rate controller is arranged to actively smooth undesired fluctuations in flow rate.

22. Apparatus according to claim 21 in which the flow rate controller comprises a valve for controllably restricting the product flow rate, comprises a sensor for sensing pressure in the region of the valve, and is arranged to vary the flow restriction provided by the valve in dependence on the pressure sensed.

23. Apparatus according to claim 12, further comprising at least one of:

a pump at the first location to aid in control of the flow rate at the first location, and a pump provided at the second location.

24. A method of downhole data communication in a producing well in which there is a flow path for a flow of product from the formation towards the surface, the data communication taking place between two locations in the flow path, at least one of which is downhole in the well, and the method comprising the steps of:

collecting the produced product from the formation and causing or allowing the produced product to flow toward the surface;

controlling a flow rate of the produced product at a first of the two locations in dependence on data to be transmitted;

measuring, at the second of the two locations, the flow rate of the produced product to detect variations in flow rate of the produced product at the second location caused by said controlling of the flow rate of the produced product at the first location; and using the results of the measuring step to extract the data transmitted, the method comprising the further steps of altering the flow rate of the produced product at the first location by at least +/−20% about an average flow rate to encode data to be transmitted and controlling the flow rate of the produced product at the first location to apply tones to the flow having a frequency in the order of 0.1 Hz or below.

25. Downhole data communication apparatus for use in a producing well in which there is a flow path for a flow of produced product from the formation towards the surface and where the data communication takes place between two locations in the flow path, at least one of which is downhole in the well, the apparatus comprising:

means for collecting the produced product from the formation and causing or allowing the produced product toward the surface;

a flow rate controller for controlling a flow rate of the produced product at a first of the two locations in dependence on data to be transmitted;

a flow rate detector disposed at the second of the two locations, for detecting the effect of controlling of the flow rate of the produced product at the first location; and an analyzer to extract transmitted data using the output of the detector, wherein the flow rate controller is arranged for altering the flow rate of the produced product at the first location by at least +/−20% about an average flow rate to encode data to be transmitted and moreover is arranged for controlling the flow rate of the produced product at the first location to apply tones to the flow having a frequency in the order of 0.1 Hz or below.

* * * * *